US012377947B2

(12) United States Patent
Fergus et al.

(10) Patent No.: US 12,377,947 B2
(45) Date of Patent: Aug. 5, 2025

(54) OUTBOARD MOTOR THAT IS REMOVABLE FROM TRANSOM CLAMP BRACKET

(71) Applicant: Brunswick Corporation, Mettawa, IL (US)

(72) Inventors: Ryan A. Fergus, Neenah, WI (US); Jeffrey D. Reifsnyder, Fond du Lac, WI (US); Wayne M. Jaszewski, Jackson, WI (US); Andrew J. Przybyl, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 910 days.

(21) Appl. No.: 17/487,116

(22) Filed: Sep. 28, 2021

(65) Prior Publication Data

US 2023/0102741 A1 Mar. 30, 2023

(51) Int. Cl.

| | |
|---|---|
| ***B63H 20/02*** | (2006.01) |
| ***B63H 20/10*** | (2006.01) |
| ***B63H 20/12*** | (2006.01) |

(52) U.S. Cl.

CPC ..... *B63H 20/02* (2013.01); *B63H 20/10* (2013.01); *B63H 20/12* (2013.01)

(58) Field of Classification Search

None

See application file for complete search history.

(56) References Cited

U.S. PATENT DOCUMENTS 1,451,452 A * 4/1923 Williams ..... B63H 21/213 74/486
2,549,481 A 4/1951 Kiekhaefer
2,808,218 A * 10/1957 Steller ..... B63H 20/14 248/641

(Continued)

FOREIGN PATENT DOCUMENTS

CN 206590092 U 10/2017
EP 1101696 A2 5/2001

(Continued)

OTHER PUBLICATIONS

PPF Mud Motors, "Quick Drop Transom Mount," website, available at least as early as Sep. 15, 2017, last accessed Jul. 5, 2021, available at http://ppfmudmotors.com/quick-drop-transom-mount/—this is the webpage screenshot.

(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

An outboard motor includes a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are (Continued)

generally vertically aligned with one another when the outboard motor is in a neutral tilt/trim position. The propulsion unit is detachable from the transom clamp bracket.

23 Claims, 11 Drawing Sheets

(56) References Cited

U.S. PATENT DOCUMENTS

| | | | | |
|---|---|---|---|---|
| 2,914,020 | A | 11/1959 | Van Raden | |
| 3,922,996 | A | 12/1975 | Meyer | |
| 3,961,595 | A | 6/1976 | Meyer | |
| 4,018,104 | A | 4/1977 | Bland et al. | |
| 4,521,201 | A | 6/1985 | Watanabe | |
| 4,701,141 | A | 10/1987 | Sumigawa | |
| 4,781,634 | A * | 11/1988 | Harris | B63H 20/34 440/66 |
| 5,102,357 | A | 4/1992 | Bruesch et al. | |
| 5,180,319 | A | 1/1993 | Shiomo et al. | |
| 5,340,342 | A | 8/1994 | Boda et al. | |
| 5,582,527 | A | 12/1996 | Nakamura | |
| 6,053,471 | A * | 4/2000 | Brown | B63H 20/007 248/642 |
| 6,146,221 | A | 11/2000 | Natsume | |
| 6,174,211 | B1 | 1/2001 | Nakamura | |
| 6,283,806 | B1 | 9/2001 | Schmidt et al. | |
| 6,402,577 | B1 | 6/2002 | Treinen | |
| 6,659,817 | B1 | 12/2003 | Anderson et al. | |
| 6,902,450 | B2 | 6/2005 | Ohtsuki et al. | |
| 7,048,600 | B1 | 5/2006 | Broussard | |
| 7,090,551 | B1 | 8/2006 | Lokken et al. | |
| 7,244,152 | B1 | 7/2007 | Uppgard | |
| 7,297,035 | B2 | 11/2007 | Broussard | |
| 7,303,595 | B1 | 12/2007 | Janitz | |
| 7,311,571 | B1 | 12/2007 | Swan | |
| 7,314,396 | B2 | 1/2008 | Kubota et al. | |
| 7,410,397 | B2 | 8/2008 | Nakamura et al. | |
| 7,681,513 | B1 | 3/2010 | Hundertmark | |
| 7,896,304 | B1 | 3/2011 | Eichinger et al. | |
| 8,069,803 | B1 | 12/2011 | Crawford | |
| 8,795,010 | B1 | 8/2014 | Wiatrowski | |
| 8,820,701 | B1 | 9/2014 | Eichinger | |
| 9,205,906 | B1 | 12/2015 | Eichinger | |
| 9,376,191 | B1 | 6/2016 | Jaszewski | |
| 9,463,859 | B1 | 10/2016 | Cooper, III et al. | |
| 9,481,434 | B1 | 11/2016 | Elchinger et al. | |
| 9,616,986 | B1 | 4/2017 | Gilk et al. | |
| 9,623,946 | B2 | 4/2017 | Delise | |
| 9,643,703 | B1 | 5/2017 | Eichinger | |
| 9,701,383 | B1 | 7/2017 | Stuber et al. | |
| 9,764,813 | B1 | 9/2017 | Zarembka et al. | |
| 9,776,699 | B1 | 10/2017 | Alby | |
| 9,783,278 | B1 | 10/2017 | Dannenberg et al. | |
| 9,789,945 | B1 | 10/2017 | Vaninetti et al. | |
| 9,963,213 | B1 | 5/2018 | Jaszewski et al. | |
| 9,969,475 | B1 | 5/2018 | Waisanen | |
| 10,005,536 | B2 | 6/2018 | Fukuchi et al. | |
| 10,124,871 | B1 | 11/2018 | Eichinger et al. | |
| 10,246,173 | B1 | 4/2019 | Ingebritson | |
| 10,464,648 | B1 * | 11/2019 | Amerling | F16F 1/36 |
| 10,696,367 | B1 | 6/2020 | Ingebritson et al. | |
| 10,787,236 | B1 | 9/2020 | Erickson et al. | |
| 11,066,140 | B1 | 7/2021 | Huffer et al. | |
| 11,097,824 | B1 | 8/2021 | Anderson, Jr. | |
| 11,866,137 | B1 | 1/2024 | Jaszewski | |
| 2009/0001244 | A1 | 1/2009 | Lucier et al. | |
| 2009/0170384 | A1 | 7/2009 | Balogh et al. | |
| 2011/0065340 | A1 | 3/2011 | Klawitter et al. | |
| 2012/0094559 | A1 | 4/2012 | Takase | |
| 2013/0316603 | A1 | 11/2013 | Hagi | |
| 2019/0344873 | A1 * | 11/2019 | Kimpara | B63H 20/32 |
| 2021/0394882 | A1 | 12/2021 | Waldvogel | |
| 2023/0102741 | A1 | 3/2023 | Fergus | |
| 2023/0192260 | A1 | 6/2023 | Dannenberg et al. | |
| 2023/0257095 | A1 | 8/2023 | Waldvogel | |
| 2024/0051650 | A1 | 2/2024 | Nickols | |

FOREIGN PATENT DOCUMENTS

| | | | |
|---|---|---|---|
| EP | 4155191 | A1 | 3/2003 |
| JP | S5654697 | U | 5/1981 |
| JP | S6479000 | A | 3/1989 |
| JP | 3976290 | B2 | 9/2007 |
| WO | 2022045986 | A1 | 3/2022 |

OTHER PUBLICATIONS

PPF Mud Motors, "PPF Wood Duck 6.5 HP Mud Motor," screenshot from photo gallery, admitted prior art, last accessed Jul. 5, 2021, available at https://ppfmudmotors.com/gallery/#swipebox.

Schrank et al., Unpublished U.S. Appl. No. 17/509,739, "Integrated Copilot and Locking Mechanism for Marine Drives", filed Oct. 25, 2021.

Podell et al., Unpublished U.S. Appl. No. 17/852,944, "Copilot Devices and Apparatuses for Supporting Marine Drives Having a Copilot Device", filed Jun. 29, 2022.

Extended European Search Report in EP22195041.3, dated Feb. 27, 2023, 9 pages.

Nickols, Thomas, Declaration of Prior Art submitted in U.S. Appl. No. 17/852,944.

Schrank et al., "Integrated Copilot and Locking Mechanism for Marine Drives," Unpublished U.S. Appl. No. 17/509,739, filed Oct. 25, 2021 (drawings, specification, and claims only).

Nickols et al., "Copilot Devices and Apparatuses for Supporting Marine Drives Having a Copilot Device," Unpublished U.S. Appl. No. 17/852,944, filed Jun. 29, 2022 (drawings, specification, and claims only).

Remigo, E-Outboard, webpage and 5 photographs, Sep. 26, 2020, available at https://web.archive.org/web/20200926115717/https://remigo.eu/.

Yamaha Motor Co., Ltd.,Yamaha 30hp Co-Pilot Manual, Feb. 2010.

Evinrude, Evinrude E-Tec 25 HP, last accessed May 11, 2021, available at: https://www.evinrude.com/en-US/e-tec/e-tec-full-specs.html#tab=12.

Evinrude, Evinrude E30DTSLAFD Tiller Arm Diagram, last accessed May 11, 2021, available at: https://www.boats.net/catalog/evinrude/outboard-by-year/af-models/e30dtslafd/tiller-arm.

Honda Motor Co., Ltd., BF25D•BF30D Owner's Manual, 2017.

Honda Marine, Honda Marine BF25DK3 SHGA S/N: BATJ-1501086 Parts List, last accessed Dec. 4, 2018, available at: http://peparts.honda.com/marine#/serial.

Honda Marine, Honda BF25-30hp Outboard Engines, last accessed May 11, 2021, available at: https://marine.honda.com/outboards/motor-detail/BF25-30#specs.

Mercury Marine, 2010 Mercury Marine 25/30 EFI FourStroke Owner's Manual.

Mercury Marine, 2015 Mercury Marine 15/20 FourStroke Outboard Installation Operation Maintenance Warranty Manual.

Suzuki Motor Corporation, DF25A-DF30A Owner's Manual, Oct. 2015.

Suzuki Motor Corporation, Suzuki DF 30A Parts Listings—2018, last accessed Dec. 4, 2018, available at: https://www.brownspoint.com/store/pc/BP_AP_AssemblyDetail.asp?ID=19761.

Yamaha Motor Co., Ltd., Yamaha F25SMHC—2006 and Later, Parts List, last accessed Dec. 4, 2018, available at: https://shop.yamahaonlineparts.com/OEMpartfinder.htm.

Yamaha Motor Co., Ltd., Yamaha F25 T25 Owner's Manual, May 2013.

Yamaha Motor Co., Ltd., 2013 Yamaha Outboard 30hp-F30LA Steering Friction Section, last accessed Dec. 4, 2018, available at: https://www.crowleymarine.com/yp/KE329296/steering-friction-f30la-2013-30hp.

Yamaha Motor Co., Ltd., 2013 Yamaha Outboard 30hp-F30LA, Bracket 1 Section, last accessed Dec. 4, 2018, available at: crowleymarine.com.

(56) References Cited

OTHER PUBLICATIONS

Examination Report in European Patent Application No. 22195041.3, dated Mar. 18, 2024, 6 pages.
Office Action issued in U.S. Appl. No. 17/960,623, dated Jun. 4, 2025.

* cited by examiner

OUTBOARD MOTOR THAT IS REMOVABLE FROM TRANSOM CLAMP BRACKET

FIELD

The present disclosure relates to outboard motors that are small and lightweight enough to be relatively easily installed on a marine vessel for use and removed from the marine vessel for transport.

BACKGROUND

U.S. Pat. No. 6,283,806 discloses a locking mechanism for an outboard motor which prevents a moveable segment of the outboard motor from rotating about a steering axis relative to a stationary segment of the outboard motor. A slidable rod is disposed within a tilt tube of the outboard motor and is connected by a connecting link to the moveable segment of the outboard motor. If a locking device, such as a pin, is inserted through holes in the tilt tube and the rod, relative movement of the tilt tube and the rod can be prevented. If this relative movement is prevented, the moveable segment of the outboard motor is locked in position relative to the stationary segment of the outboard motor to which the tilt tube is attached.

U.S. Pat. No. 6,659,817 discloses first and second pliable members that are each attached to an outboard motor and to a fixed location on the transom or transom bracket associated with the outboard motor. One pliable member is used on the starboard side of the outboard motor while another is used on the port side. As the outboard motor is tilted about its trim axis, the two pliable members work in coordination with each other to exert a force on the outboard motor in a direction away from any direction in which the outboard motor is rotated about its steering axis as it is being tilted about its trim axis. This coordinated action by the two pliable members aligns the outboard motor in a straight ahead position when it is tilted upward into an inoperable position for transportation.

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

The above-noted patents and patent application are hereby incorporated herein by reference in their entireties.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An outboard motor according to one example of the present disclosure comprises a transom clamp bracket configured to be supported on a transom of a marine vessel and a swivel bracket configured to be supported by the transom clamp bracket. A propulsion unit is configured to be supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

In some examples, the propulsion unit is detachable from the transom clamp bracket without the use of tools.

In some examples, the swivel bracket is pivotable with respect to the transom clamp bracket so as to tilt and/or trim the propulsion unit with respect to the transom of the marine vessel.

According to some examples, the swivel bracket is connected to the propulsion unit and the swivel bracket and propulsion unit are detachable together as a unit from the transom clamp bracket. In some examples, a tilt tube is connected between a pair of arms of the transom clamp bracket, and the swivel bracket comprises a notch configured to receive and be supported by the tilt tube. In some examples, a tab bracket is provided on the swivel bracket, the tab bracket configured to be moved between a locked position in which the tilt tube is trapped within the notch by the tab bracket and an unlocked position in which the tilt tube is not trapped within the notch by the tab bracket and the swivel bracket is able to be removed from the tilt tube.

According to some examples, a steering assembly is connected to the propulsion unit, and the steering assembly and the propulsion unit are detachable together as a unit from the swivel bracket and the transom clamp bracket. In some examples, the steering assembly comprises a steering tube configured to be supported by the swivel bracket and a steering arm supported by the steering tube, wherein the steering arm is connected to the propulsion unit. In some examples, a pin extends through the swivel bracket and is configured to be received within a notch in the steering tube, the pin configured to be moved between a locked position in which the pin is received in the notch and the steering tube is prevented from being removed from the swivel bracket and an unlocked position in which the pin is not received in the notch and the steering tube is able to be removed from the swivel bracket. In some examples, the swivel bracket comprises a hollow tube for receiving the steering tube therein. The hollow tube comprises a seat therein. In some examples, the steering tube comprises a fitting configured to rest on the seat so as to support the steering tube within the hollow tube of the swivel bracket.

Another example of an outboard motor according to the present disclosure comprises a transom clamp bracket configured to be supported on a transom of a marine vessel and a propulsion unit configured to be supported by the transom clamp bracket. The propulsion unit comprises a head unit, a midsection below the head unit, and a lower unit below the midsection, wherein the head unit, midsection, and lower unit are generally vertically aligned with one another when the outboard motor is in a neutral tilt/trim position. The outboard motor has a support bracket assembly by way of which the propulsion unit is suspended from the transom clamp bracket, and the support bracket assembly and propulsion unit are detachable together as a unit from the transom clamp bracket.

In some examples, the support bracket assembly and propulsion unit are detachable together as a unit from the transom clamp bracket without the use of tools.

According to some examples, the support bracket assembly comprises a swivel bracket supported by the transom clamp bracket, the swivel bracket supporting the propulsion unit. In some examples, the swivel bracket is pivotable with respect to the transom clamp bracket so as to tilt and/or trim the propulsion unit with respect to the transom of the marine vessel. In some examples, the swivel bracket is connected to the propulsion unit and the swivel bracket and propulsion unit are detachable together as a unit from the transom clamp bracket. In some examples, a tilt tube is connected between a pair of arms of the transom clamp bracket, and the swivel bracket comprises a notch configured to receive and be supported by the tilt tube. In some examples, the support bracket assembly further comprises a tab bracket on the swivel bracket, the tab bracket configured to be moved between a locked position in which the tilt tube is trapped within the notch by the tab bracket and an unlocked position in which the tilt tube is not trapped within the notch by the tab bracket and the swivel bracket is able to be removed from the tilt tube.

According to some examples, a swivel bracket is supported by the transom clamp bracket, and the support bracket assembly comprises a steering tube configured to be supported by the swivel bracket and a steering arm supported by the steering tube, wherein the steering arm supports the propulsion unit. In some examples, the steering arm is connected to the propulsion unit, and the steering arm, steering tube, and propulsion unit are detachable together as a unit from the swivel bracket and the transom clamp bracket. In some examples, a pin extends through the swivel bracket and is configured to be received within a notch in the steering tube, the pin configured to be moved between a locked position in which the pin is received in the notch and the steering tube is prevented from being removed from the swivel bracket and an unlocked position in which the pin is not received in the notch and the steering tube is able to be removed from the swivel bracket. In some examples, the swivel bracket comprises a hollow tube for receiving the steering tube therein. In some examples, the hollow tube comprises a seat therein. In some examples, the steering tube comprises a fitting configured to rest on the seat so as to support the steering tube within the hollow tube of the swivel bracket.

BRIEF DESCRIPTION OF THE DRAWINGS

Examples are described with reference to the following drawing figures. The same numbers are used throughout to reference like features and components.

DETAILED DESCRIPTION

Figure 1:
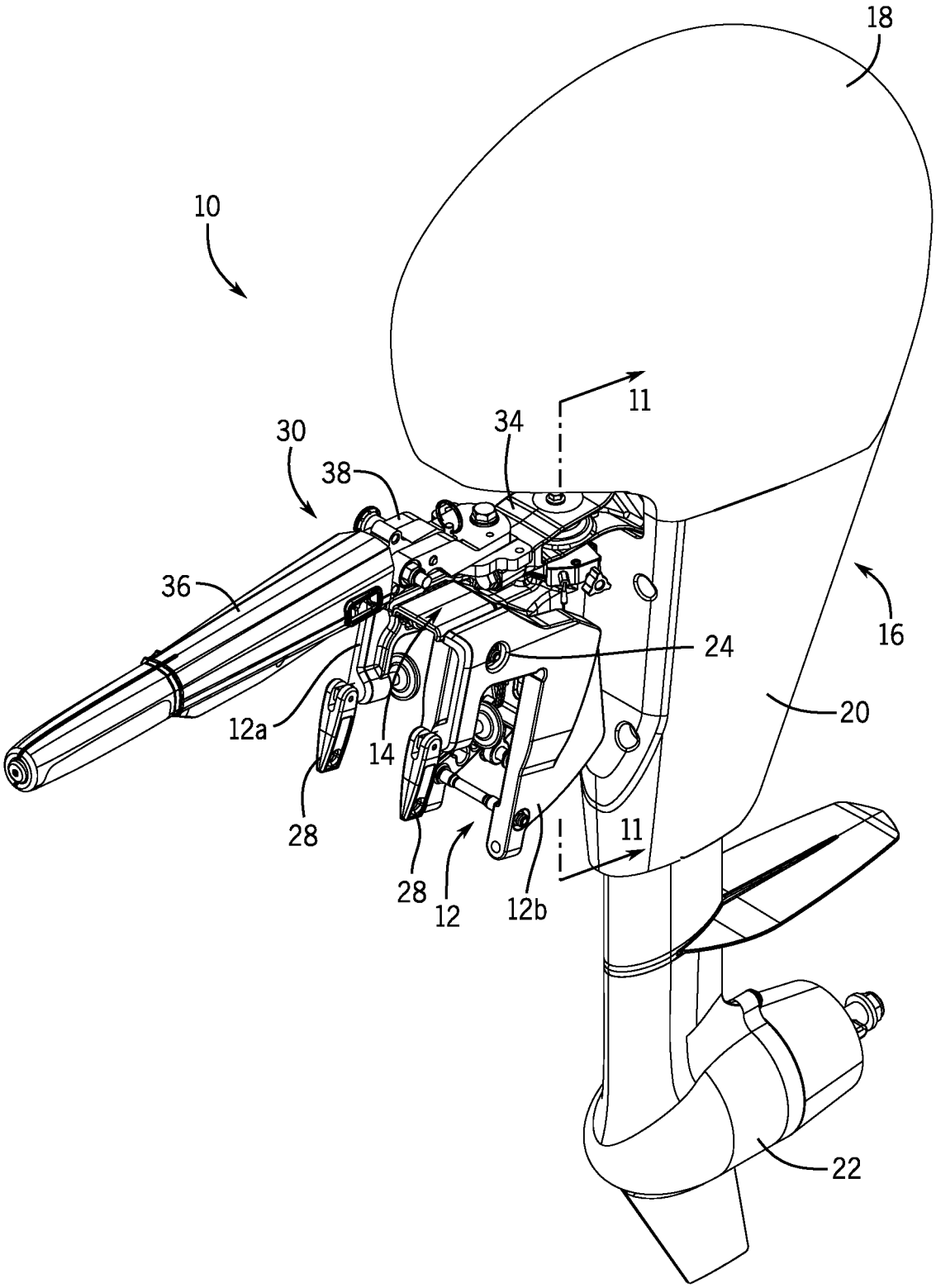
FIG. 1 is a forward, port-side perspective view of an outboard motor according to one example of the present disclosure.
Figure 2:
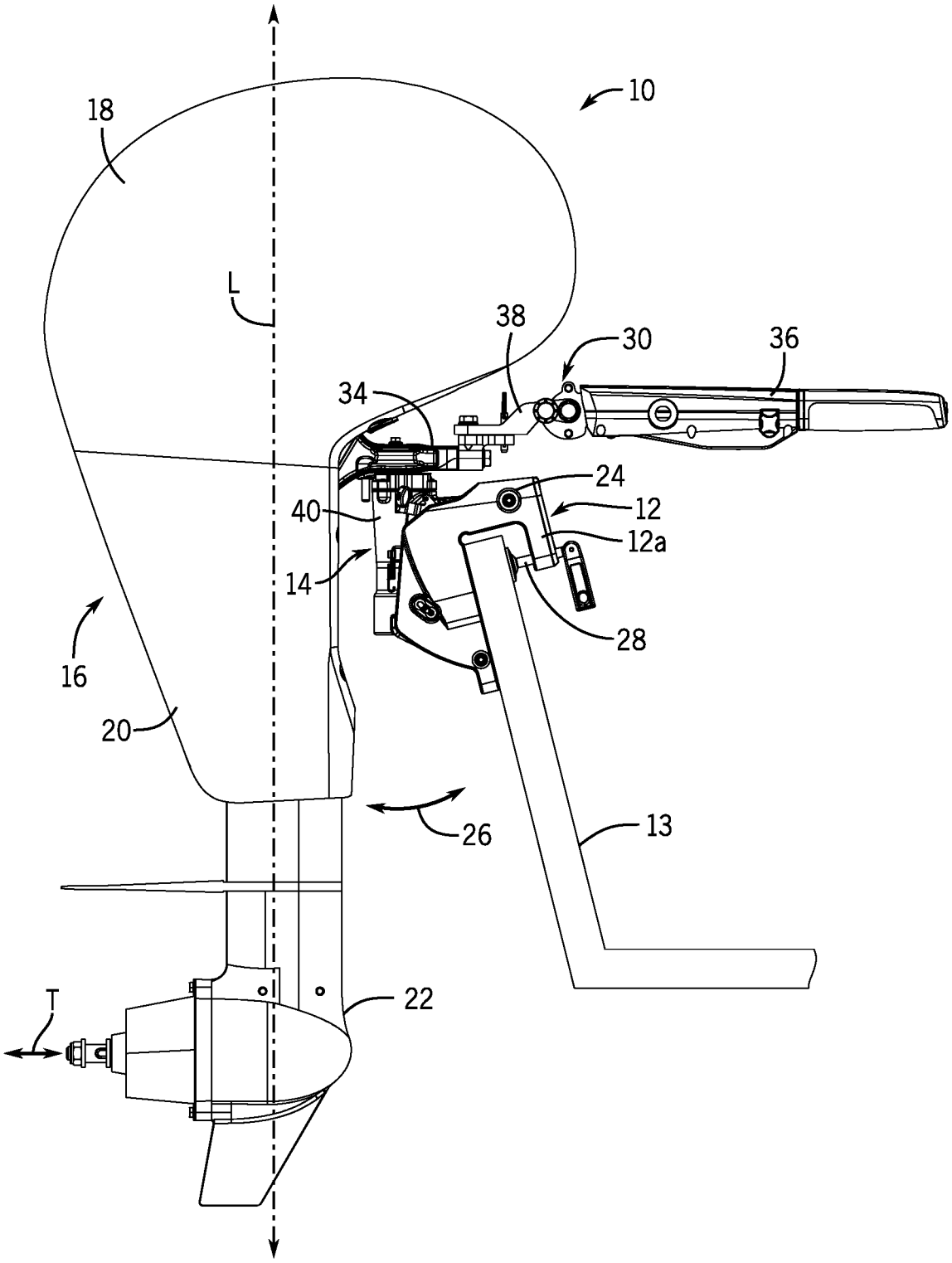
FIG. 2 is starboard-side view of the outboard motor of FIG. 1, installed on a transom of a marine vessel.

FIGS. 1 and 2 show an outboard motor 10 according to one example of the present disclosure. The outboard motor 10 comprises a transom clamp bracket 12 configured to be supported on a transom 13 of a marine vessel (FIG. 2) and a swivel bracket 14 configured to be supported by the transom clamp bracket 12. A propulsion unit 16 is configured to be supported by the swivel bracket 14, the propulsion unit 16 comprising a head unit 18, a midsection 20 below the head unit 18, and a lower unit 22 below the midsection 20. Although not shown here, a propeller may be provided on the aft end of the lower unit 22, which propeller is powered to propel the marine vessel through water. The type of outboard propulsion unit 16 may vary, and in other examples, the propulsion unit 16 may be a jet drive that utilizes an impeller instead of a propeller, or a forward-facing drive having a propeller on the fore side of the lower unit 22. The propulsion unit 16 may be powered by an internal combustion engine located in the head unit 18, or by an electric motor located in the head unit 18 or the lower unit 22.

The head unit 18, midsection 20, and lower unit 22 are generally vertically aligned with one another when the outboard motor 10 is in a neutral tilt/trim position, as shown in FIGS. 1 and 2. Referring to FIG. 2 more specifically, the propulsion unit 16 is tiltable and trimmable about a tilt tube 24, which defines a tilt/trim axis, as shown by arrow 26. The tilt tube 24 is connected between a pair of arms 12*a*, 12*b* of the transom clamp bracket 12, such as by the opposite ends of the tilt tube 24 extending through apertures in the arms 12*a*, 12*b* and being secured on the outer sides of the arms 12*a*, 12*b* with washers and nuts. The swivel bracket 14 is pivotably connected to the tilt tube 24 at the fore end of the swivel bracket 14, such as by the tilt tube 24 extending through apertures in the swivel bracket 14. The swivel bracket 14 is manually pivotable with respect to the transom clamp bracket 12 so as to tilt and/or trim the propulsion unit 16 with respect to the transom 13 of the marine vessel. Trimming of the propulsion unit 16 allows the propeller to be angled differently with respect to the transom 13, while tilting of the propulsion unit 16 allows the propulsion unit 16 to be moved to a transport position while the marine vessel to which it is connected is trailered. The "neutral" tilt/trim position is the one shown in FIG. 2, in which the propeller or other propulsor on the lower unit 22 would produce thrust (see arrow T) generally horizontally, and the longitudinal axis L running through the head unit 18, midsection 20, and lower unit 22 is generally vertically aligned.

The transom clamp bracket 12 is attachable to the transom 13 of the marine vessel by adjustable clamps 28 that extend through each of the respective arms 12*a*, 12*b* of the transom clamp bracket 12 and are configured to rest on an inside surface of the transom 13. The outside surface of the transom 13 supports the opposite portions of the arms 12*a*, 12*b* of the transom clamp bracket 12, which are both configured with an upside-down U-shape to fit over the upper edge of the transom 13. Such an arrangement is well known and will not be described further herein.

A steering assembly 30 is connected to the propulsion unit 16, the steering assembly 30 comprising a steering tube 32 (see FIGS. 3, 5, and 11) configured to be supported by the swivel bracket 14 and a steering arm 34 supported by the steering tube 32. Here, the steering arm 34 is connected to the propulsion unit 16, such as by being bolted thereto or such as by being integral with a support structure that holds or supports components within the head unit 18 and/or midsection 20. The steering assembly 30 also includes a tiller 36, which is coupled to the steering arm 34 by way of a bolted bracket 38. As is known, an operator can use the tiller 36 to steer the propulsion unit 16, control a speed of the propulsion unit 16, and interact with the propulsion unit 16 in other known ways to affect the magnitude and direction of thrust produced by the propulsion unit 16. The tiller 36 is pivotable about the bracket 38 connecting the tiller 36 to the steering arm 34 so as to place the tiller 36 in a folded, transport position. The tiller 36 is a conventional item, and the type and configuration of the tiller 36 can vary from what is shown. Suitable examples are disclosed in U.S. Pat. Nos. 10,246,173; 9,789,945; 9,783,278; and 9,764,813; which are incorporated herein by reference.

According to the present disclosure, the propulsion unit 16 is detachable from the transom clamp bracket 12. In fact, in the present example, the propulsion unit 16 is detachable from the transom clamp bracket 12 without the use of tools, such as wrenches, screw drivers, or other tools other than the operator's hands, as will now be described. Note, however, that in some embodiments the outboard motor 10 is provided with an anti-theft device, which may require the use of a key or other type of unique key-like tool for removal of the propulsion unit 16 from the transom clamp bracket 12. Such anti-theft devices are usually aftermarket assemblies, and it is here noted that such a key is not considered to be a "tool" as discussed herein.

Figure 3:
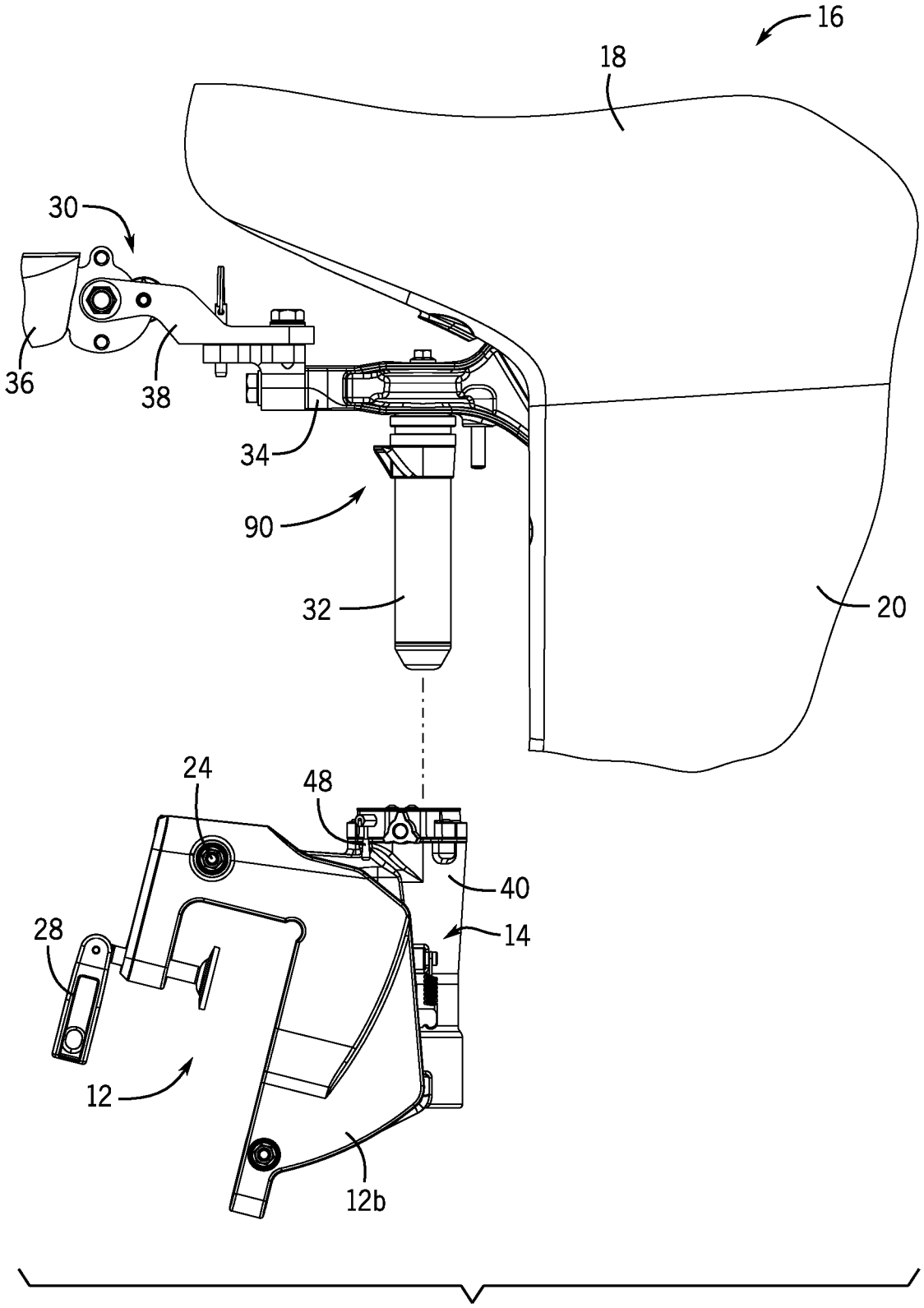
FIG. 3 shows portions of the outboard motor, with the propulsion unit thereof detached from the transom clamp bracket.

FIG. 3 illustrates the propulsion unit 16 detached from the transom clamp bracket 12. As shown in FIG. 3, the steering assembly 30 (including steering tube 32 configured to be supported by the swivel bracket 14 and a steering arm 34 supported by the steering tube 32) is connected to the propulsion unit 16. As shown, the steering assembly 30 and the propulsion unit 16 are detachable together as a unit from the swivel bracket 14 and the transom clamp bracket 12. In other words, the steering assembly 30 and propulsion unit 16 remain connected together as they are separated from the swivel bracket 14. More specifically, the steering tube 32, steering arm 34, and propulsion unit 16 are coupled in such a manner that the steering tube 32 can be lifted out of the swivel bracket 14, and with it the steering arm 34, tiller 36, and the propulsion unit 16. The swivel bracket 14 meanwhile remains coupled to the transom clamp bracket 12 way of the tilt tube 24. The transom clamp bracket 12 remains clamped with clamps 28 to the transom 13, while the propulsion unit 16 is be removed from the transom 13 and can be transported elsewhere.

Figure 4:
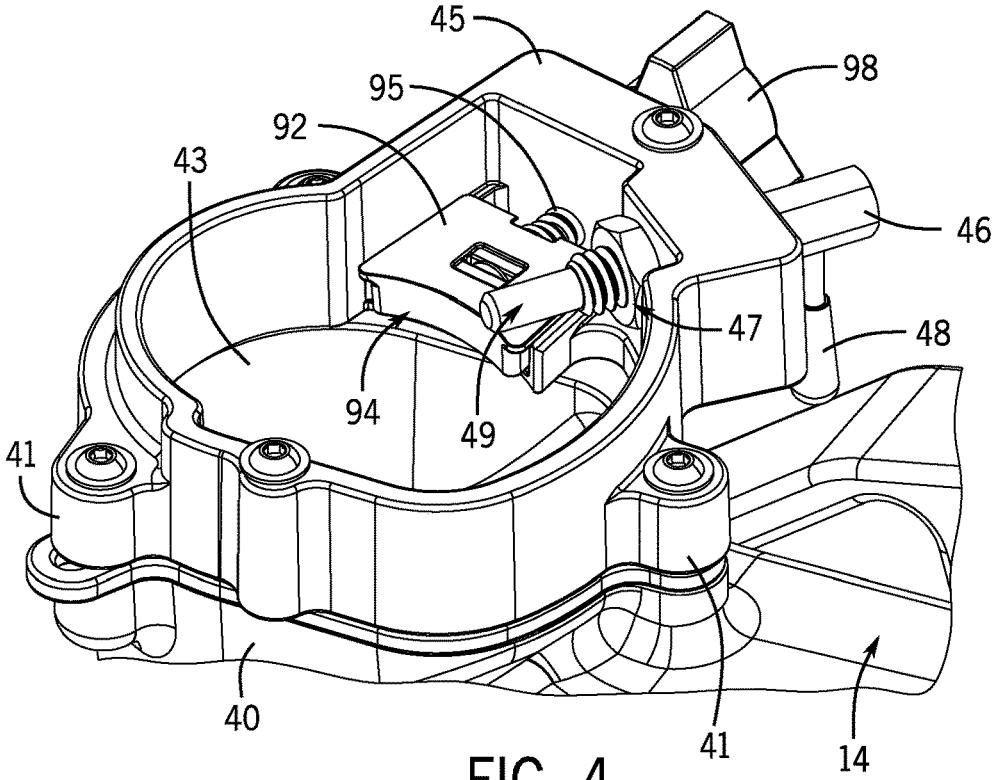
FIG. 4 shows a top perspective view of a portion of a swivel bracket of the outboard motor.
Figure 5:
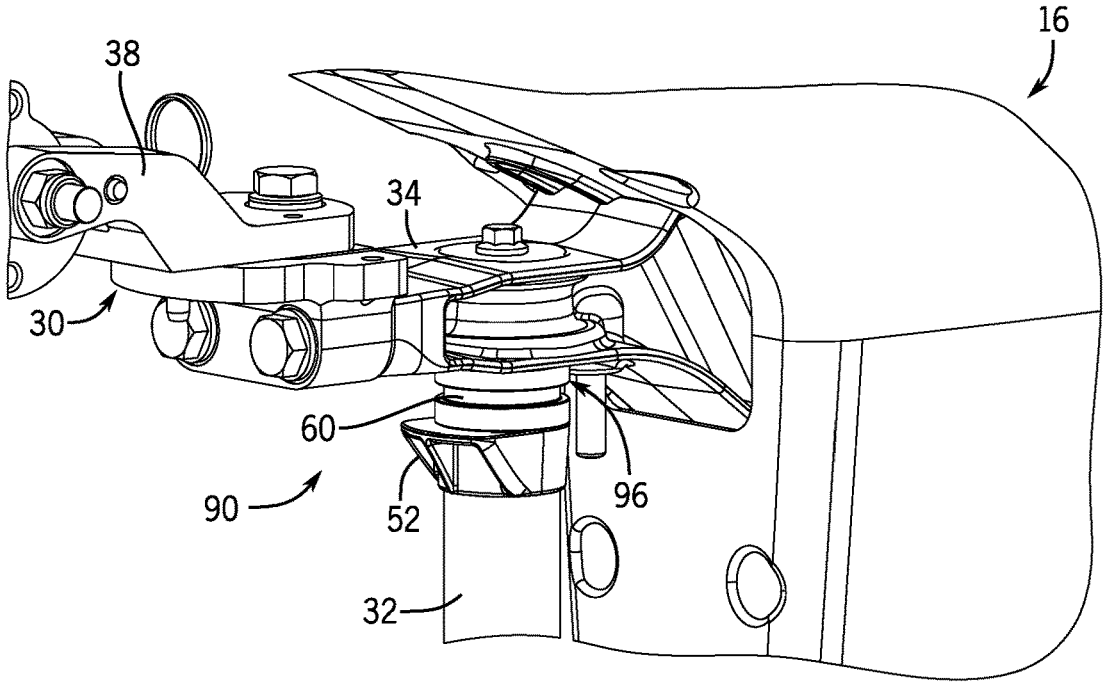
FIG. 5 shows a port-side perspective view of a portion of the propulsion unit and steering assembly of the outboard motor.
Figure 6:
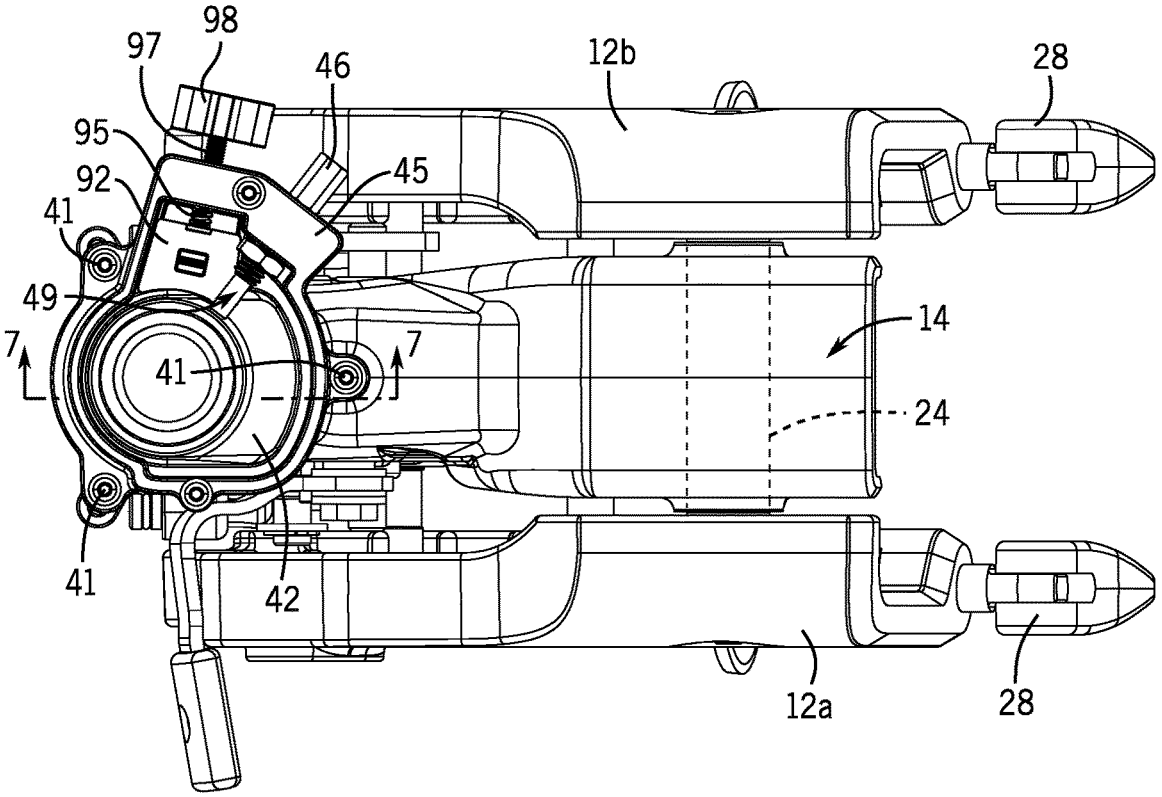
FIG. 6 shows a top view of a portion of the swivel bracket of FIG. 4.
Figure 7:
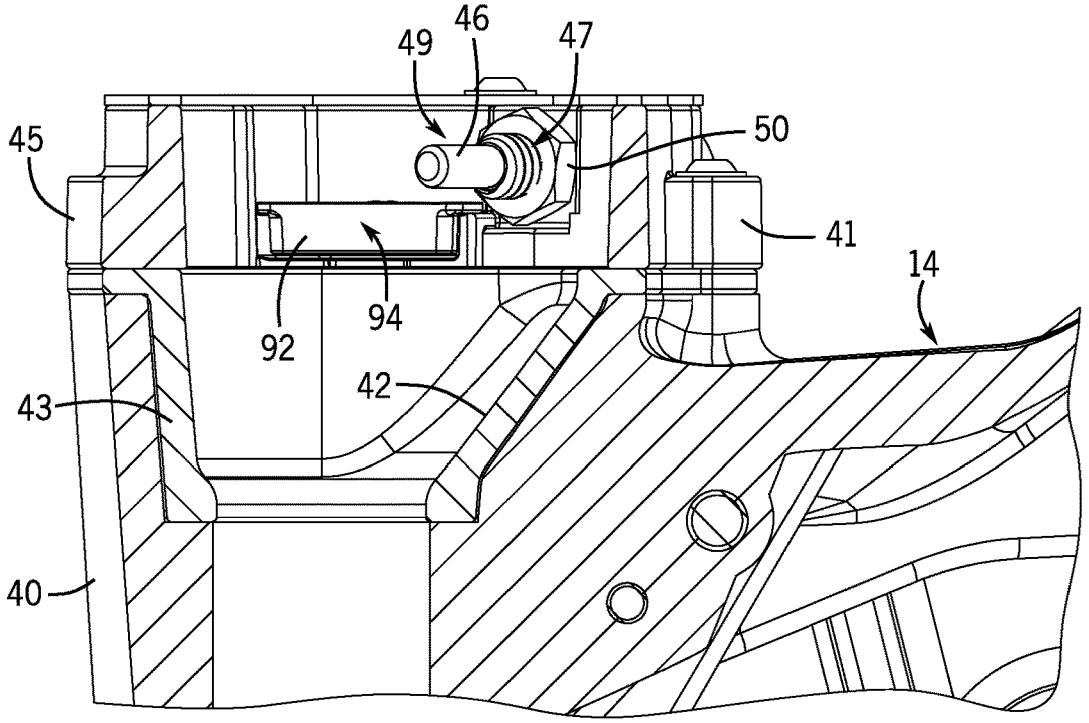
FIG. 7 shows a cross-sectional view of the swivel bracket taken along the line 7-7 in FIG. 6.
Figure 8:
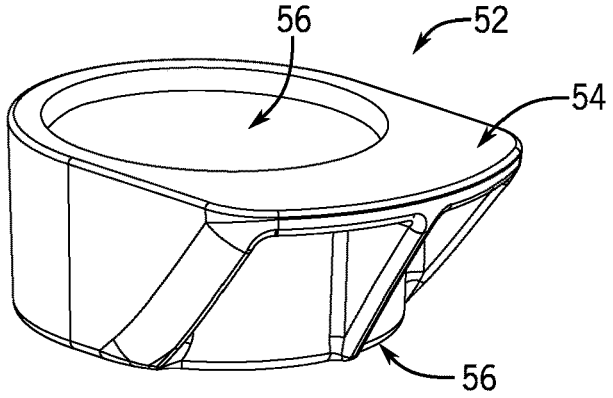
FIG. 8 shows a perspective view of a fitting for placement on a steering tube of the outboard motor.
Figure 9:
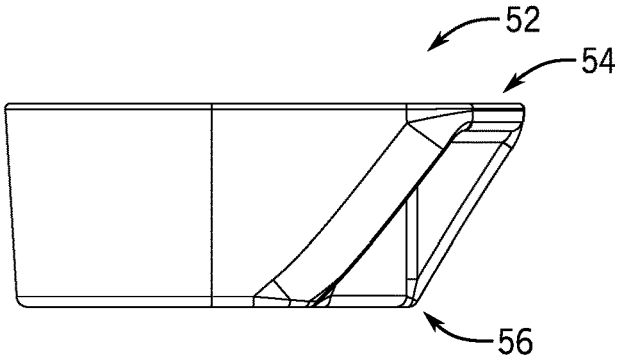
FIG. 9 shows a side view of the fitting of FIG. 8.
Figure 10:
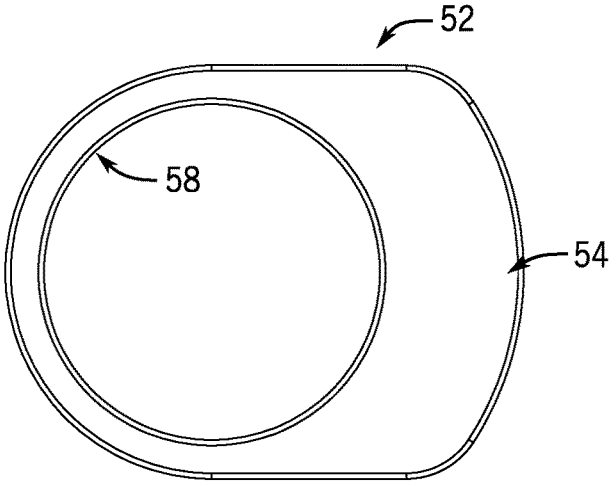
FIG. 10 shows a top view of the fitting of FIGS. 8 and 9.

FIG. 4 shows a top starboard-side perspective view of a portion of the swivel bracket 14 without the steering tube 32 installed therein, while FIG. 5 shows a port-side perspective view of the steering assembly 30 and propulsion unit 16 when the steering tube 32 is not installed in the swivel bracket 14. The swivel bracket 14 comprises a hollow tube 40 at the aft end thereof for receiving the steering tube 32 therein. As its name suggests, the steering tube 32 is likewise tubular, and is sized and shaped to fit within the hollow tube 40 of the swivel bracket 14. Referring now also to FIGS. 6 and 7, the hollow tube 40 comprises a seat 42 therein. The seat 42 is located on the fore side of the hollow tube 40, but the seat 42 could be located elsewhere. In the present example, the seat 42 is formed by a cup 43 that fits into the upper end of the hollow tube 40, but the seat 42 could instead be formed directly on the inner surface of the hollow tube 40.

A housing 45 is supported on top of the cup 43, and the housing 45 and cup 43 have lugs 41 that allow them to be bolted to a flange on the upper end of the hollow tube 40. The housing 45 holds a pin 46 that extends through the swivel bracket 14, more specifically through the inner and outer walls of the housing 45. The pin 46 may be threaded along a portion of its length, as shown at 47, such that an operator can twist a handle 48 (FIG. 4), which is coupled to the pin 46 and provided outside the housing 45, so as to thread the pin 46 further into the swivel bracket 14 or further out of the swivel bracket 14. A nut 50 (FIG. 7) may be provided on the threaded portion 47, adjacent the inside wall of the housing 45, to secure the pin 46. The threaded portion 47 extends through the housing 45 so that the pin 46 cannot move on its own laterally within the housing 45. At least part of the end of the pin 46 that is within the hollow of the swivel bracket 14 is left unthreaded (as shown at 49), however, for reasons described below. Although the housing 45 and pin 46 are shown here as being on the port side of the outboard motor 10, in other examples, the housing 45 and pin 46 could be provided on the starboard side or the fore side of the swivel bracket 14. In still other examples, no housing is provided, and the pin 46 extends directly through the hollow tube 40 of the swivel bracket 14 and/or through the cup 43 therein. In still other examples, a housing for the pin 46 is formed integrally at the upper end of the hollow tube 40.

Referring to FIGS. 5 and 8-11, the steering tube 32 comprises a fitting 52 provided on the outer surface of the steering tube 32. The outer diameter of the steering tube 32 where the fitting 52 is held can be reduced slightly in comparison to the outer diameter of the steering tube 32 above and below the fitting 52, so as to seat the fitting 52 at a particular location along the length of the steering tube 32. See FIG. 11. The fitting 52 on the steering tube 32 is configured to rest on the seat 42 within the hollow tube 40 of the swivel bracket 14 so as to support the steering tube 32 within the hollow tube 40 of the swivel bracket 14. The fitting 52 is sized and shaped to be seated directly against the seat 42. For example, the fitting 52 has an upper, fore portion 54 that is configured to be seated in the upper, fore portion of the seat 42. The upper, fore portion 54 of the fitting 52 slopes downwardly to a lower, fore portion 56, which is cylindrical to match the cylindrical portion of the seat 42 in this location. Comparing FIGS. 9 and 7, it can be seen that this taper or slope from the upper fore portion 54 to the lower fore portion 56 helps to guide the steering tube 32 into the hollow tube 40 of the swivel bracket 14 in the correct orientation. Further, as can be seen by comparing FIGS. 10 and 6, the cross-sectional shape of the fitting 52 is the same as the shape of the seat 42 and inside of the hollow tube 40. This further serves to align the fitting 52 and steering tube 32 with respect to the swivel bracket 14, as well as to prevent the fitting 52 from rotating within the swivel bracket 14. Meanwhile, the inside surface 58 of the fitting 52 is cylindrical, to match the outer surface of the steering tube 32.

Figure 11:
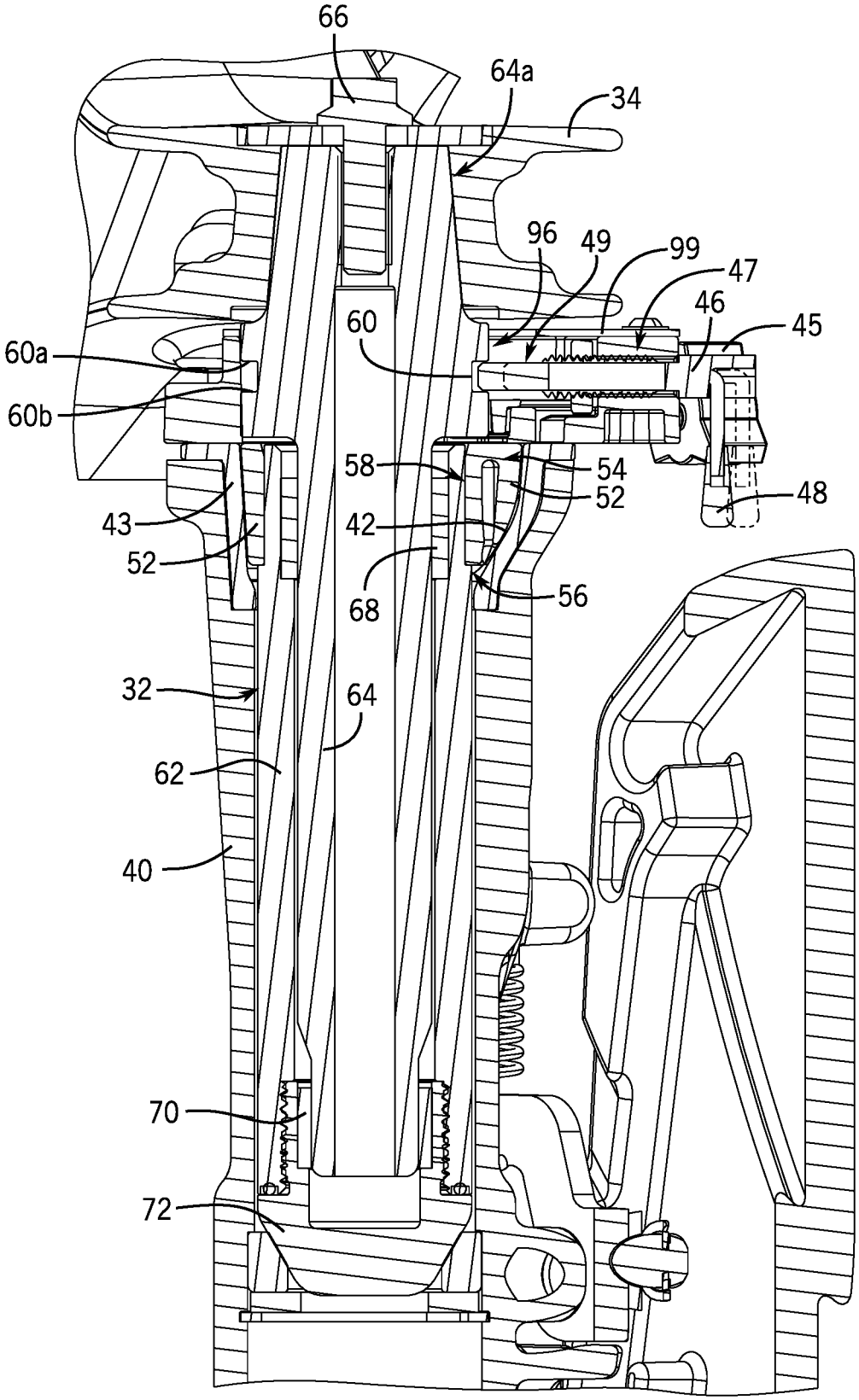
FIG. 11 shows a cross-sectional view of a portion of the outboard motor, taken along the line 11-11 in FIG. 1.

Referring back to FIG. 5, and also to FIG. 11, the steering tube 32 has a annular notch 60 provided in its outer surface, directly below where the steering tube 32 connects to the steering arm 34. The notch 60 extends around the outer surface of the steering tube 32 in the form of a band and has an upper surface 60*a* and lower surface 60*b*. As shown in FIG. 11, the pin 46 that extends through the housing 45 of the swivel bracket 14 is configured to be received within the notch 60 in the steering tube 32. In other words, the diameter of the pin 46 at the non-threaded end 49 is configured to fit between the upper and lower surfaces 60*a*, 60*b* of the notch 60. Although the diameter of the pin 46 at the end 49 is shown as being just slightly smaller than the height of the notch 60 in the present example, the diameter of the pin 46 at the end 49 could be more significantly smaller than the height of the notch 60 in other examples.

By way of turning the pin 46 using the handle 48, the pin 46 is configured to be moved between a locked position, shown in solid lines in FIG. 11, in which the pin 46 is received in the notch 60, and an unlocked position, shown in dashed lines in FIG. 11, in which the pin 46 is not received in the notch 60. To move the pin 46 from the locked position to the unlocked position, the handle 48 is twisted to unscrew the pin 46 and move it laterally outwardly away from the steering tube 32. To move the pin 46 from the unlocked position to the locked position, the handle 48 is twisted to screw the pin 46 further laterally inwardly toward the steering tube 32.

When the pin 46 is received in the notch 60, the steering tube 32 is prevented from being removed from the swivel bracket 14. Contact between the pin 46 and the lower surface 60*b* of the notch 60 prevents the steering tube 32 from being lifted out of the hollow tube 40 of the swivel bracket 14. With the pin 46 in the unlocked position, in which the pin 46 is not received in the notch 60, the steering tube 32 is able to be removed from the swivel bracket 14. The steering tube 32 is no longer prevented from being lifted upwardly by contact between the pin 46 and the lower surface 60*b* of the notch 60 after the pin 46 is withdrawn from the notch 60.

The steering tube 32 comprises an outer tube 62 and an inner tube 64. The inner tube 64 rotates within the outer tube 62 when the operator steers the propulsion unit 16. This is because an upper end 64*a* of the inner tube 64 is connected to the steering arm 34 (at bolt 66), which is in turn connected to the bracket 38, which is in turn connected to the tiller 36. Thus it is the inner tube 64, which extends upwardly above and out of the outer tube 62, which has the notch 60 formed in the outer surface thereof for receiving the pin 46. As noted herein above, the inner end 49 of the pin 46 is not threaded, so that it can ride smoothly within the notch 60 in the inner tube 64 of the steering tube 32 as the inner tube 64 rotates within the swivel bracket 14. The outer tube 62 remains stationary as the tiller 36 is moved to steer the propulsion unit 16, because the fitting 52 seated around the outside of the outer tube 62 prevents rotation of the outer tube 62. An upper bearing 68 located concentrically with the fitting 52 and a lower bearing 70 at the lower end of the inner tube 64 facilitate smooth rotation of the inner tube 64 within the outer tube 62. A threaded end fitting 72 on the lower end of the outer tube 62 holds the lower bearing 70 in place.

To install the propulsion unit 16 on the transom clamp bracket 12, the operator turns the handle 48 of the pin 46 to move the pin 46 laterally outwardly away from the center of the hollow tube 40. The operator then lines up the fitting 52 on the steering tube 32 with the seat 42 within the hollow tube 40 of the swivel bracket 14, as shown in FIG. 3. Then, the operator moves the propulsion unit 16 downwardly, inserting the steering tube 32 into the swivel bracket 14, until the fitting 52 is seated on the seat 42 within the hollow tube 40. The operator then twists the handle 48 on the pin 46 in the opposite direction, to move the pin 46 laterally inwardly until its non-threaded end 49 is located within the notch 60 in the steering tube 32. To remove the propulsion unit 16 from the transom clamp bracket 12, the operator turns the handle 48 of the pin 46 to move the pin 46 out of the notch 60, then lifts the propulsion unit 16 and steering assembly 30 connected thereto from the swivel bracket 14.

Referring back to FIGS. 4-7, another component herein referred to as a "copilot" 92 is held by the housing 45. The copilot 92 has a radially inwardly facing concave surface 94 that is configured to abut the outer circumferential surface 96 of the steering tube 32, more specifically of the inner tube 64 (see FIG. 11). The copilot 92 is movable radially inwardly toward the steering tube 32 and radially outwardly away from the steering tube 32 by way of an actuator, here in the form of a bolt 97 connected to a handle 98 located outside the housing 45. Other types of actuators, such as a ratcheting device, could be used. As shown in FIGS. 4 and 6, a spring 95 is provided about the bolt 97 and trapped between the inner surface of the housing 45 and the radially outward face of the copilot 92. The spring 95 biases the copilot 92 radially inwardly toward the steering tube 32. By turning the handle 98 in one direction, the bolt 97 is advanced inwardly toward the steering tube 32, thereby pressing the surface 94 of the copilot 92 against the outer surface 96 of the inner tube 64. Depending on how tightly the copilot 92 is pressed against the steering tube 32, a different amount of friction will be provided between the contacting surfaces 94 and 96. This friction can be great enough that the steering tube 32 is held in place despite attempted operator input to the tiller 36 or forces on the propulsion unit 16 as it moves through water, thus fixing the thrust direction of the propulsion unit 16. Alternatively, this friction can be adjusted to provide an operator-desired level of resistance to steering, while still allowing the tiller 36 to be moved to change the direction of thrust of the propulsion unit 16. To lessen the friction or disengage the surface 94 from the surface 96 altogether, the handle 98 is turned in the opposite direction. As shown in FIG. 11, a plate 99 can be provided over the housing 45 to protect the copilot 92 and pin 46 from the elements. This plate 99 is removed in FIGS. 4 and 6 to better show the components within the housing 45.

FIGS. 12-15 show portions of an outboard motor 110 according to another example of the present disclosure. The outboard motor 110 comprises a transom clamp bracket 112 configured to be supported on a transom of a marine vessel and a swivel bracket 114 configured to be supported by the transom clamp bracket 112. A propulsion unit 116 is configured to be supported by the swivel bracket 114, the propulsion unit 116 comprising a head unit, a midsection below the head unit, and a lower unit below the midsection. The propulsion unit 116 is shown generally in phantom, it being understood that the head unit, midsection, and lower unit are similar to those shown in FIG. 1. For instance, the head unit, midsection, and lower unit are generally vertically aligned with one another when the outboard motor 110 is in a neutral tilt/trim position (i.e., with the longitudinal axis of the propulsion unit 116 aligned generally vertically and the propulsor producing generally horizontal thrust). According to the present disclosure, the propulsion unit 116 is detachable from the transom clamp bracket 112.

Figure 12:
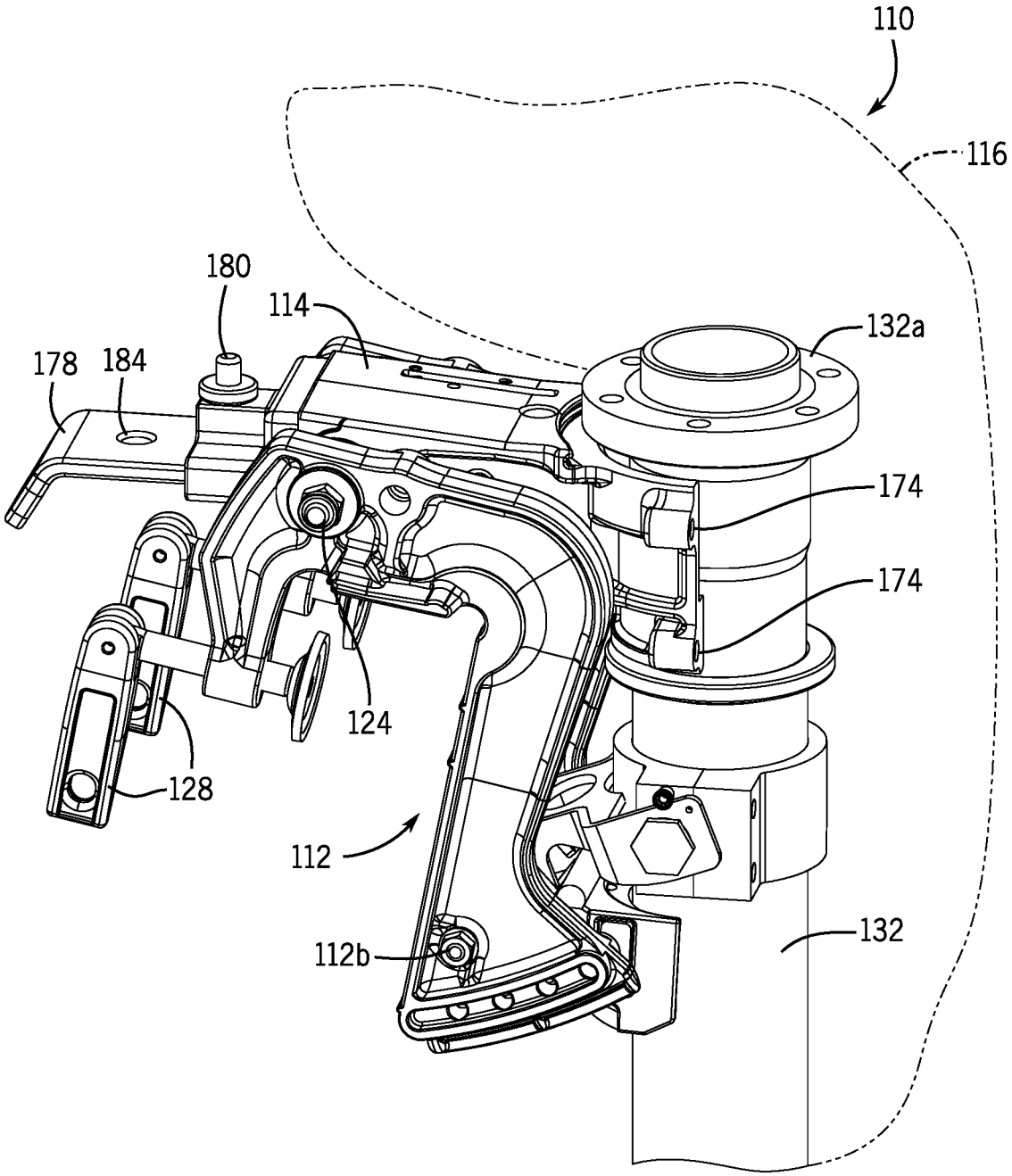
FIG. 12 shows a port-side perspective view of a portion of an outboard motor according to another example of the present disclosure.
Figure 13:
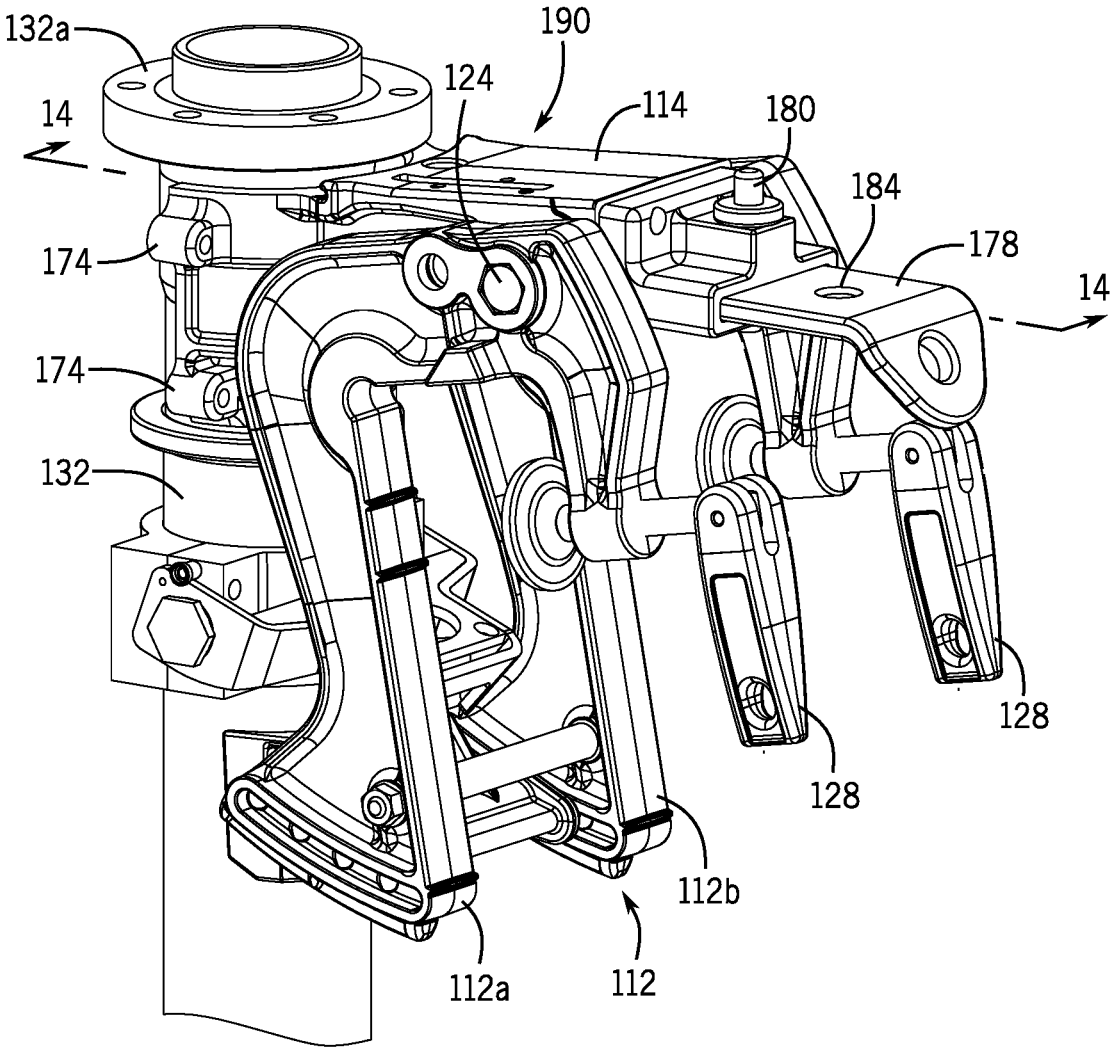
FIG. 13 shows a front, starboard-side perspective view of the portion of the outboard motor of FIG. 12.
Figure 15:
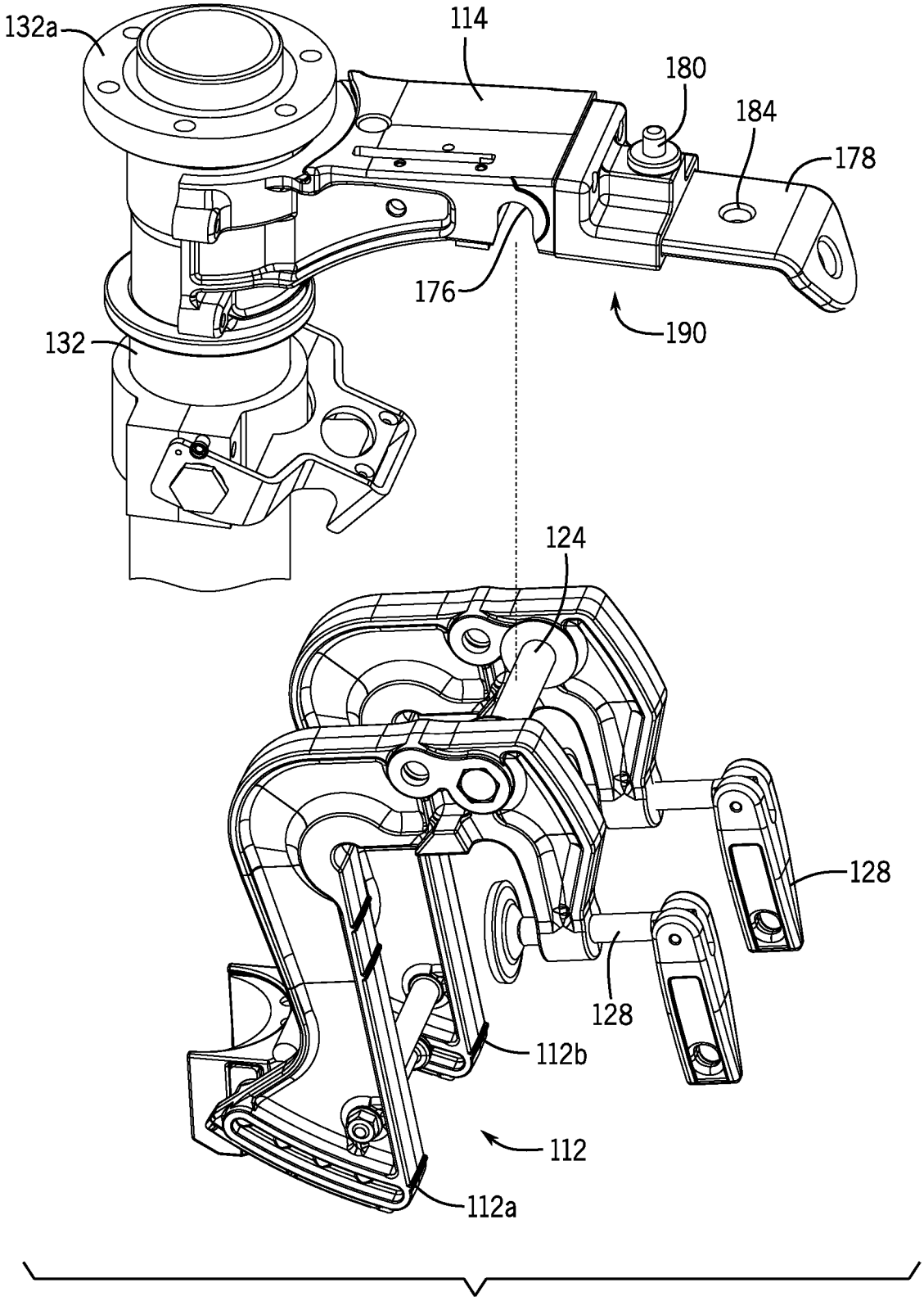
FIG. 15 shows the portions of the outboard motor in another configuration, with the propulsion unit and swivel bracket removed from the transom clamp assembly.

As shown in FIGS. 12 and 13, the swivel bracket 114 is connected to the propulsion unit 116, such as being bolted thereto by bolts (not shown) extending through lugs 174 in the aft end of the swivel bracket 114 and into the propulsion unit 116, such as into a midsection housing thereof. The aft end of the swivel bracket 114 is curved such that the cylindrical steering tube 132 can be located therein. The flange at the upper end 132*a* of the steering tube 132 can be bolted to a steering arm (not shown), which is in turn coupled to a tiller (not shown). As shown in FIG. 15 and described herein below, the swivel bracket 114 and propulsion unit 116 are detachable together as a unit from the transom clamp bracket 112. In other words, the swivel bracket 114 and propulsion unit 116 can remain connected together while they are both removed from the transom clamp bracket 112, which remains connected to the transom by way of the clamps 128.

Figure 14A:
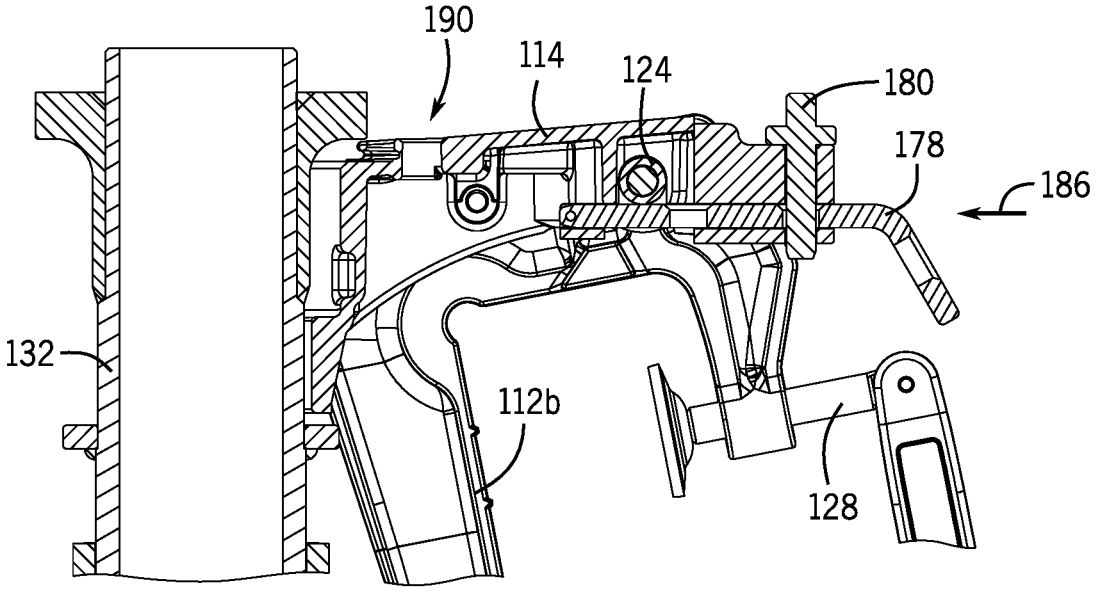
FIGS. 14A and 14B show cross-sectional views of the portion of the outboard motor, taken along line 14-14 in FIG. 13.

Referring now also to FIGS. 14A, B and 15, a tilt tube 124 is connected between a pair of arms 112*a*, 112*b* of the transom clamp bracket 112. The swivel bracket 114 can pivot about a pivot axis defined along the tilt tube 124, to manually tilt and trim the propulsion unit 116 with respect to the transom. The swivel bracket 114 comprises a notch 176 (FIGS. 14B, 15) configured to receive and be supported by the tilt tube 124. A tab bracket 178 is provided on the swivel bracket 114. The tab bracket 178 is configured to be moved between a locked position (FIG. 14A) in which the tilt tube 124 is trapped within the notch 176 by the tab bracket 178, and an unlocked position (FIG. 14B) in which the tilt tube 124 is not trapped within the notch 176 by the tab bracket 178, and the swivel bracket 114 is able to be removed from the tilt tube 124. In fact, FIG. 14B shows the swivel bracket 114 partially removed from the tilt tube 124 (or not yet fully installed on the tilt tube 124), with the tilt tube 124 not yet quite contacting the hollow of the notch 176, in order to show the notch 176 better.

Figure 14B:
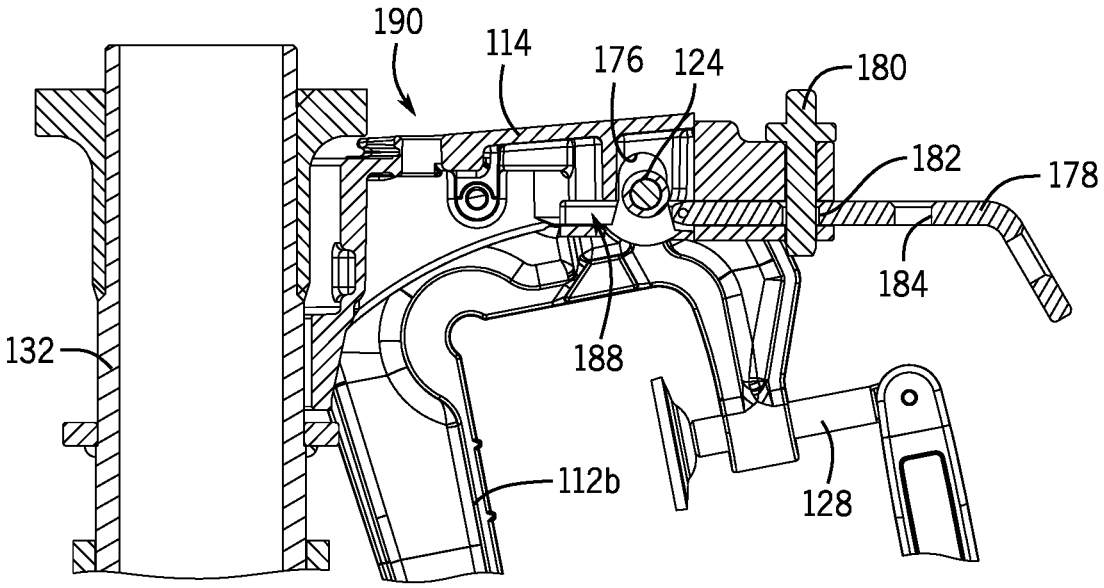

To install the propulsion unit 116 and swivel bracket 114 connected thereto onto the transom clamp bracket 112, the tab bracket 178 is moved to the unlocked position of FIG. 14B, i.e., pulled forward toward the transom. A pin 180 may be inserted into a hole 182 in the tab bracket 178 to maintain the tab bracket 178 in the unlocked position. Alternatively, no hole 182 is provided (see FIG. 14A), and the pin 180 simply rests on top of the tab bracket 178 when the tab bracket 178 is in the unlocked position. The operator positions the propulsion unit 116 and swivel bracket 114 so that the notch 176 in the underside of the swivel bracket 114 is aligned with the tilt tube 124, as shown in FIG. 15. The propulsion unit 116 and swivel bracket 114 are then lowered onto the transom clamp bracket 112, until the tilt tube 124 is fully inserted in the notch 176 (FIG. 14A). The operator then pushes the tab bracket 178 aft (in the direction of arrow 186) until the aft end of the tab bracket 178 is located in a receiving space 188 in the lower surface of the swivel bracket 114. The pin 180 can then be inserted into a hole 184 to lock the tab bracket 178 in the locked position.

To remove the propulsion unit 116 and swivel bracket 114 together as a unit from the transom clamp bracket 112, the operator pulls the tab bracket 178 forward to the position shown in FIG. 14B, then lifts the swivel bracket 114 off the tilt tube 124.

Thus, the outboard motors 10, 110 according to the present disclosure comprise a transom clamp bracket 12, 112 configured to be supported on a transom 13 of a marine vessel and a propulsion unit 16, 116 configured to be supported by the transom clamp bracket 12, 112. The propulsion unit 16, 116 comprises a head unit 18, a midsection 20 below the head unit 18, and a lower unit 22 below the midsection 20, wherein the head unit 18, midsection 20, and lower unit 22 are generally vertically aligned with one another when the outboard motor 10, 110 is in a neutral tilt/trim position. The outboard motor 10, 110 has a support bracket assembly 90, 190 (FIGS. 3, 14A, B) by way of which the propulsion unit 116 is suspended from the transom clamp bracket 12, 112, wherein the support bracket assembly 90, 190 and propulsion unit 16, 116 are detachable together as a unit from the transom clamp bracket 12, 112.

According to one example, the support bracket assembly 190 comprises a swivel bracket 114 supported by the transom clamp bracket 112, the swivel bracket 114 supporting the propulsion unit 116. The swivel bracket 114 is pivotable with respect to the transom clamp bracket 112 so as to tilt and/or trim the propulsion unit 116 with respect to the transom 13 of the marine vessel. The swivel bracket 114 is connected to the propulsion unit 116, and the swivel bracket 114 and propulsion unit 116 are detachable together as a unit from the transom clamp bracket 112. A tilt tube 124 is connected between a pair of arms 112*a*, 112*b* of the transom clamp bracket 112, wherein the swivel bracket 114 comprises a notch 176 configured to receive and be supported by the tilt tube 124. The support bracket assembly 190 further optionally comprises a tab bracket 178 on the swivel bracket 114, the tab bracket 178 configured to be moved between a locked position in which the tilt tube 124 is trapped within the notch 176 by the tab bracket 178, and an unlocked position in which the tilt tube 124 is not trapped within the notch 176 by the tab bracket 178 and the swivel bracket 114 is able to be removed from the tilt tube 124.

According to another example, a swivel bracket 14 is supported by the transom clamp bracket 12, and the support bracket assembly 90 comprises a steering tube 32 configured to be supported by the swivel bracket 14 and a steering arm 34 supported by the steering tube 32, wherein the steering arm 34 supports the propulsion unit 16. The steering arm 34 is connected to the propulsion unit 16, and the steering arm 34, steering tube 32, and propulsion unit 16 are detachable together as a unit from the swivel bracket 14 and the transom clamp bracket 12. A pin 46 extends through the swivel bracket 14 and is configured to be received within a notch 60 in the steering tube 32, the pin 46 being configured to be moved between a locked position in which the pin 46 is received in the notch 60 and the steering tube 32 is prevented from being removed from the swivel bracket 14, and an unlocked position in which the pin 46 is not received in the notch 60 and the steering tube 32 is able to be removed from the swivel bracket 14. The swivel bracket 14 comprises a hollow tube 40 for receiving the steering tube 32 therein. Optionally, the hollow tube 40 comprises a seat 42 therein. Optionally, the steering tube 32 comprises a fitting 52 configured to rest on the seat 42 so as to support the steering tube 32 within the hollow tube 40 of the swivel bracket 14.

In some examples, the support bracket assembly 90, 190 and propulsion unit 16, 116 are detachable together as a unit from the transom clamp bracket 12, 112 without the use of tools. For example, the pin 46 can be screwed into and out of the swivel bracket 14 by hand via the handle 48. The tab bracket 178 can be pulled and pushed within the swivel bracket 114 by hand, and the pin 180 is also placeable by hand. As noted herein above, in embodiments in which the outboard motor 10, 110 is provided with an anti-theft device, the key or other type of unique key-like tool for removal of the propulsion unit 16, 116 from the transom clamp bracket 12, 112 is not considered to be a "tool" as referred to herein as not being required for such removal of the propulsion unit 16, 116.

Although the above examples are described as being steerable with a tiller, in other examples, the propulsion units 16, 116 are steered remotely by input to a steering wheel, joystick, automatic steering algorithm, foot pedal, or other known steering device, which may be physically and/or electronically connected to the steering arm 34, 134 as appropriate.

Although the above examples are described as being manually trimmed and tilted, in other examples, the transom clamp brackets 12, 112 are equipped with hydraulic, electric, or pneumatic tilt/trim systems, which may pivot the swivel bracket 14, 114 about the tilt tube 24, 124 so as to tilt and trim the propulsion unit 16, 116 with respect to the transom 13.

By providing a propulsion unit 16, 116 that is easily connected to and disconnected from the transom clamp bracket 12, 112, the present inventors have solved the problem of needing to unclamp the clamps (e.g., 28, 128) that hold the transom clamp bracket to the transom every time an operator wants to remove the outboard motor for storage or transport. Typically, additional fasteners, including screws, washers, and nuts, are recommended to add mounting security to the installation of the transom clamp bracket on the transom, but operators who want a portable outboard motor do not use these additional fasteners. Having a propulsion unit that can be removed from the transom clamp bracket allows an operator to safely and securely install the transom clamp bracket on the transom, while still providing the operator with the convenience of a transportable outboard motor.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An outboard motor comprising:

a transom clamp bracket configured to be supported on a transom of a marine vessel;

a propulsion unit configured to be supported by the transom clamp bracket;

a swivel bracket supported by the transom clamp bracket; and a support bracket assembly by way of which the propulsion unit is suspended from the transom clamp bracket, wherein the support bracket assembly and the propulsion unit are detachable together as a unit from the transom clamp bracket, wherein the support bracket assembly comprises a steering tube configured to be supported by the swivel bracket and a steering arm supported by the steering tube, and wherein the steering arm supports the propulsion unit and is connected to the propulsion unit;

wherein the steering arm, the steering tube, and the propulsion unit are detachable together as a unit from the swivel bracket and the transom clamp bracket; and wherein the swivel bracket comprises a hollow tube for receiving the steering tube therein, the hollow tube comprises a seat therein, and the steering tube comprises a fitting configured to rest on the seat so as to support the steering tube within the hollow tube of the swivel bracket.

2. The outboard motor of claim 1, wherein the support bracket assembly and the propulsion unit are detachable together as a unit from the transom clamp bracket without the use of tools.

3. An outboard motor comprising:

a transom clamp bracket configured to be supported on a transom of a marine vessel;

a swivel bracket configured to be supported by the transom clamp bracket;

a propulsion unit configured to be supported by the swivel bracket;

wherein the propulsion unit is detachable from the transom clamp bracket; and wherein the swivel bracket is connected to the propulsion unit and the swivel bracket and propulsion unit are detachable together as a unit from the transom clamp bracket;

a tilt tube connected between a pair of arms of the transom clamp bracket, wherein the swivel bracket comprises a notch configured to receive and be supported by the tilt tube; and a tab bracket on the swivel bracket, the tab bracket configured to be moved between a locked position in which the tilt tube is trapped within the notch by the tab bracket and an unlocked position in which the tilt tube is not trapped within the notch by the tab bracket and the swivel bracket is able to be removed from the tilt tube.

4. An outboard motor comprising:

a transom bracket configured to be supported on a transom of a marine vessel;

a swivel bracket pivotably coupled to the transom bracket;

a propulsion unit configured to be supported on the swivel bracket; and a steering assembly including a steering tube and a steering arm that couples the steering tube to the propulsion unit;

wherein the swivel bracket includes a hollow tube in which the steering tube is seated when the propulsion unit is supported on the swivel bracket, and wherein the propulsion unit and the steering assembly are removable together from the swivel bracket by lifting the steering tube out of the hollow tube.

5. The outboard motor according to claim 4, wherein the steering tube includes an inner tube and an outer tube on the inner tube, the inner tube configured to rotate in the outer tube when the propulsion unit is supported on and steered relative to the swivel bracket.

6. The outboard motor according to claim 5, wherein the inner tube is fixedly coupled to the steering arm.

7. The outboard motor according to claim 5, further comprising upper and lower bearings that facilitate rotation of the inner tube relative to the outer tube.

8. The outboard motor according to claim 4, wherein the hollow tube has a seat and further comprising a fitting on the steering tube, the fitting being configured to rest on the seat when the steering tube is seated in the hollow tube.

9. The outboard motor according to claim 8, wherein the fitting has a taper that guides the steering tube into a desired orientation in the hollow tube as the propulsion unit is installed on the swivel bracket.

10. The outboard motor according to claim 4, further comprising pin that is movable into a locked position in which the steering tube is prevented from being removed from the swivel bracket and an unlocked position in which the steering tube is removable from the swivel bracket.

11. The outboard motor according to claim 10, further comprising a handle for moving the pin into and out of the locked position.

12. The outboard motor according to claim 4, further comprising a copilot configured to apply friction to the steering tube to resist steering of the steering tube relative to the swivel bracket.

13. The outboard motor according to claim 12, wherein the copilot is movable radially inwardly and outwardly relative to the steering tube.

14. The outboard motor according to claim 12, further comprising an actuator configured to vary the friction applied by the copilot to the steering tube.

15. The outboard motor according to claim 12, further comprising a handle that is operable to vary the friction applied by the copilot to the steering tube.

16. The outboard motor according to claim 12, further comprising a spring that biases the copilot towards the steering tube.

17. An apparatus for coupling an outboard motor to a marine vessel, the apparatus comprising:

a transom bracket configured to be supported on a transom of a marine vessel;

a swivel bracket pivotably coupled to the transom bracket; and a steering assembly including a steering arm for an outboard motor and a steering tube extending from the steering arm;

wherein the swivel bracket includes a hollow tube in which the steering tube is seated when outboard motor is supported on the swivel bracket, and wherein the steering arm and the steering tube are removable together from the swivel bracket by lifting the steering tube out of the hollow tube.

18. The apparatus according to claim 17, wherein the steering tube includes an inner tube and an outer tube on the inner tube, the inner tube configured to rotate in the outer tube when the outboard motor is supported on and steered relative to the swivel bracket.

19. The apparatus according to claim 18, wherein the inner tube is fixedly coupled to the steering arm.

20. The apparatus according to claim 17, wherein the hollow tube has a seat and further comprising a fitting on the steering tube, the fitting being configured to rest on the seat when the steering tube is seated in the hollow tube, wherein the fitting has a taper that guides the steering tube into a desired orientation in the hollow tube as the outboard motor is installed on the swivel bracket.

21. The apparatus according to claim 17, further comprising pin that is movable into a locked position in which the steering tube is prevented from being removed from the swivel bracket and an unlocked position in which the steering tube is removable from the swivel bracket.

22. The apparatus according to claim 17, further comprising a copilot configured to apply friction to the steering tube to resist steering of the steering tube relative to the swivel bracket.

23. The apparatus according to claim 22, further comprising an actuator configured to vary the friction applied by the copilot to the steering tube.

* * * * *